US007249970B1

(12) United States Patent
Wei

(10) Patent No.: US 7,249,970 B1
(45) Date of Patent: Jul. 31, 2007

(54) CONNECTOR FOR COAXIAL CABLE

(75) Inventor: Kai-Chih Wei, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 11/647,377

(22) Filed: Dec. 29, 2006

(51) Int. Cl.
*H01R 9/05* (2006.01)

(52) U.S. Cl. ..... 439/585; 439/866

(58) Field of Classification Search ..... 439/578, 439/585, 866
See application file for complete search history.

(56) References Cited

U.S. PATENT DOCUMENTS 6,217,381 B1 * 4/2001 Kameyama ..... 439/578
6,384,335 B1 * 5/2002 Saito et al. ..... 174/74 R
6,554,644 B2 * 4/2003 Koide ..... 439/585
6,709,290 B2 * 3/2004 Yoshida ..... 439/585
6,808,417 B2 * 10/2004 Yoshida ..... 439/585

* cited by examiner

*Primary Examiner*—Thanh-Tam Le
(74) *Attorney, Agent, or Firm*—Troxell Law Office, PLLC

(57) ABSTRACT

A connector ensuring good mechanical and electrical connection to a coaxial cable includes a metal housing; an insulating element mounted in the metal housing and having a split end portion; a connecting terminal inserted in the split end portion of the insulating element to thereby associate therewith, and having a split end portion for receiving and electrically connecting to a center conductor of a coaxial cable; and a fixing element attached to an outer side of the metal housing, and having a first pair of wings inward bent to compress against the split end portion of the insulating element for the same to apply a force against the split end portion of the connecting terminal, so that the center conductor of the coaxial cable is firmly held to the connecting terminal without the risk of loosening therefrom.

7 Claims, 5 Drawing Sheets

CONNECTOR FOR COAXIAL CABLE

FIELD OF THE INVENTION

The present invention relates to a connector for use with IT (intelligent terminal) equipment, such as laptop computers and compact electronic devices for household appliances; and more particularly to a connector for mechanically and electrically connecting to a coaxial cable.

BACKGROUND OF THE INVENTION

Coaxial cables are frequently used in internal wiring of IT equipment, such as laptop computers and compact electronic devices for household appliances. When it is desired to electrically connect two coaxial cables together, the conductors in one coaxial cable must be separately connected to the conductors in the other coaxial cable. Conventionally, two coaxial cables are electrically connected by welding their respective center conductors together.

However, connection errors frequently occur in the welding process, and it is uneasy to precisely electrically connect two coaxial cable center conductors to each other.

Moreover, the welding process is complicate and time-consuming. Therefore, any failure in the welding process would cause serious loss.

Therefore, it is desirable to develop a coaxial cable connector that can be firmly connected to the center conductor of the micro coaxial cable without the need of welding.

SUMMARY OF THE INVENTION

A primary object of the present invention is to provide a connector for coaxial cable that has simple structure and can be firmly connected to a coaxial cable without the need of welding.

To achieve the above and other objects, the connector for coaxial cable according to the present invention includes a metal housing; an insulating element mounted in the metal housing and having a split end portion; a connecting terminal inserted in the split end portion of the insulating element to thereby associate therewith, and having a split end portion for receiving and electrically connecting to a center conductor of a coaxial cable; and a fixing element attached to an outer side of the metal housing. The fixing element includes a first pair of wings inward bent to compress against the split end portion of the insulating element for the same to apply a force against the split end portion of the connecting terminal, so that the center conductor of the coaxial cable is always firmly held to the connecting terminal without the risk of loosening therefrom, ensuring good mechanical and electrical connection of the connector to the coaxial cable.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
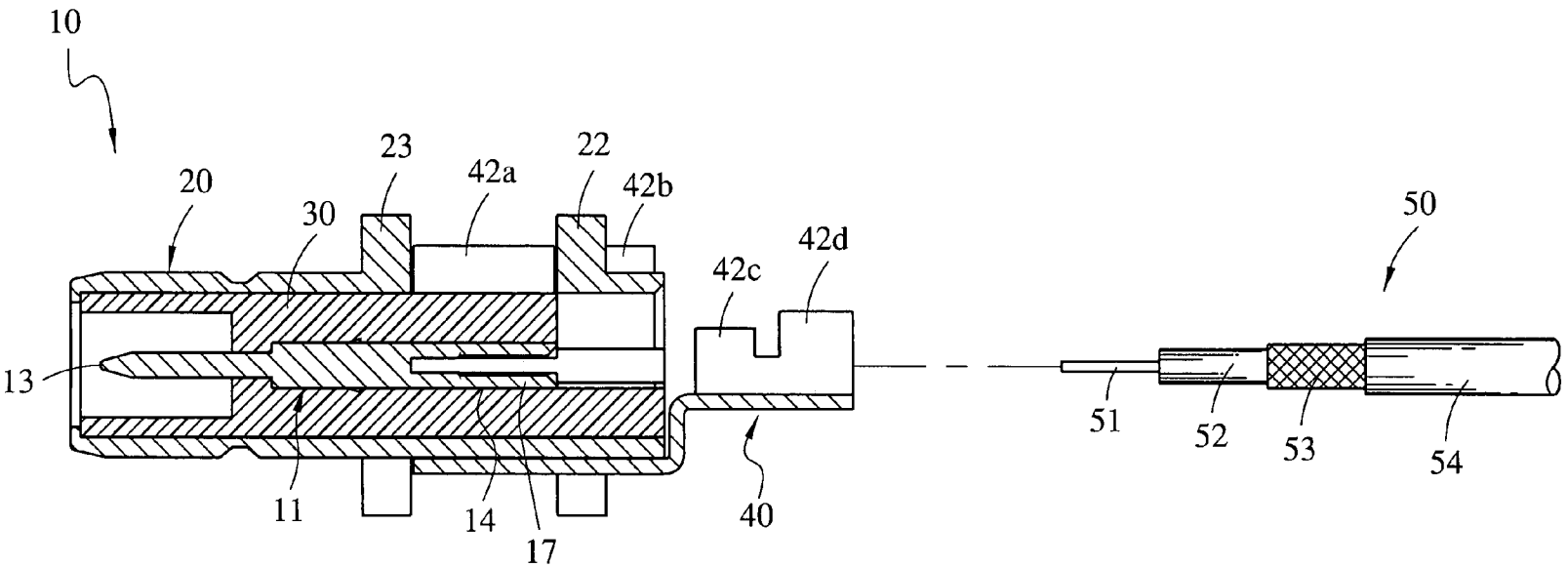
FIG. 1 is a sectioned side view of a connector for coaxial cable according to the present invention before a coaxial cable is connected thereto.

Please refer to FIG. 1 that is a sectioned side view of a connector 10 for coaxial cable according to the present invention before a coaxial cable 50 is connected thereto. As can be seen from FIG. 1, a commonly used coaxial cable 50 includes a center conductor 51, an insulating spacer 52 surrounding the center conductor 51, at least one layer of cylindrical conducting screen 53 surrounding the insulating spacer 52, and an outer sheath 54 surrounding the cylindrical conducting screen 53. Please also refer to FIGS. 2 and 3 that are assembled and exploded perspective views, respectively, of the connector 10 for coaxial cable shown in FIG. 1. The connector 10 for coaxial cable according to the present invention includes a connecting terminal 11 for electrically connecting with the center conductor 51 of the coaxial cable 50, a metal housing 20, an insulating element 30 received in the metal housing 20 to support the connecting terminal 11 therein, and a fixing element 40 forcing the connecting terminal 11 and the center conductor 51 of the coaxial cable 50 to tightly connect to each other, so as to ensure firm and stable electrical connection of the connector 10 to the coaxial cable 50 all the time.

The metal housing 20 internally defines an axial guide way 21, in which the insulating element 30 is mounted. The metal housing 20 further includes a front stop plate 22 and a rear stop plate 23, which are perpendicular to the axial guide way 21 and spaced from each other by a predetermined distance. A portion of the metal housing 20 between the front and the rear stop plate 22, 23 is in the form of a curved connecting plate 24; and the front stop plate 22 has a circular flange 25 forward extended therefrom.

The insulating element 30 has a first end 31 and a second end 32. The second end 32 has an axially extended slit 33 to thereby form a split end portion 34 having a shorter half 34*a* and a longer half 34*b*. The shorter half 34*a* and the longer half 34*b* are correspondingly formed at respective inner sides facing toward each other with an axially extended recess 35 each, so that the two recesses 35 together define a hole for receiving the connecting terminal 11 therein and thereby associating the connecting terminal 11 with the insulating element 30.

Figure 2:
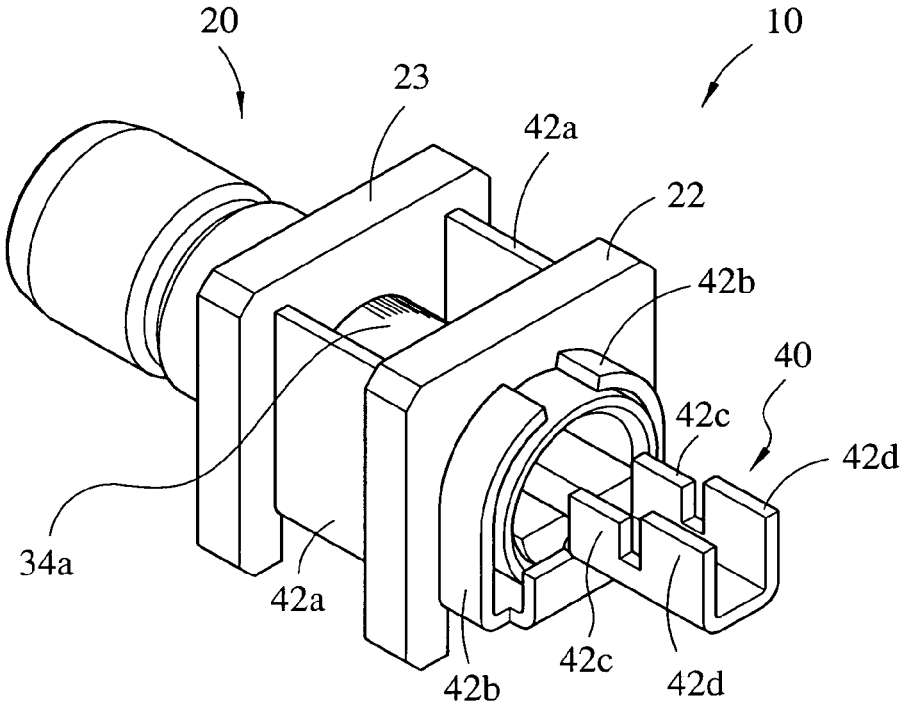
FIG. 2 is an assembled perspective view of the connector for coaxial cable shown in FIG. 1.
Figure 3:
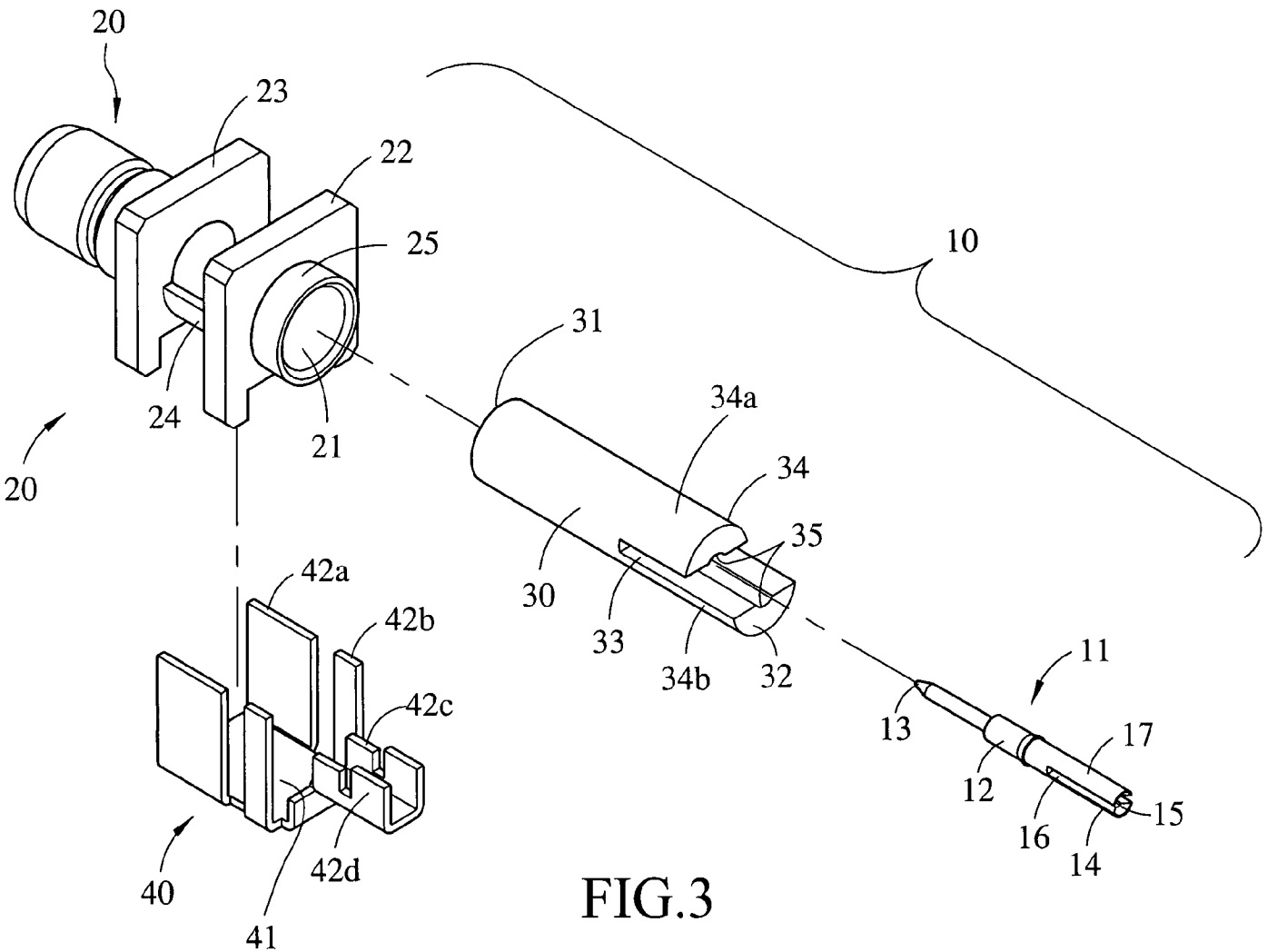
FIG. 3 is an exploded perspective view of the connector for coaxial cable shown in FIG. 2.

The fixing element 40 includes a main body 41 and at least one pair of wings formed thereon. As can be best seen from FIG. 3, there are four pairs of wings formed on the main body 41 of the fixing element 40, namely, a first, a second, a third, and a fourth pair of wings 42*a*, 42*b*, 42*c*, 42*d*. Each of the four pairs of wings 42*a*, 42*b*, 42*c*, and 42*d* has two wings upward extended from two lateral sides of the main body 41 by a predetermined length. The fixing element 40 is attached to an outside of the metal housing 20 with the second pair of wings 42*b* mechanically forced by a tool to bend inward to thereby directly fitly press against an outer surface of the circular flange 25 of the metal housing 20, so that the fixing element 40 is associated with the metal housing 20, as shown in FIG. 2.

The connecting terminal 11 may be directly inserted into the hole formed from the two recesses 35 in the insulating element 30 to associate with the insulating element 30. The connecting terminal 11 has a slender body 12 with a tapered nose 13 and a slightly expanded rear end 14. The rear end 14 of the connecting terminal 11 has an axially extended slit 16 to thereby form a split end portion 17, in which an elongate hole 15 is formed. The elongate hole 15 of the connecting terminal 11 is designed to receive a full length of the center conductor 51 of the coaxial cable 50 with the rear end 14 of the connecting terminal 11 pressed against a front end of the insulating spacer 52, preventing the coaxial cable 50 from moving any further into the connecting terminal 11.

Figure 4A:
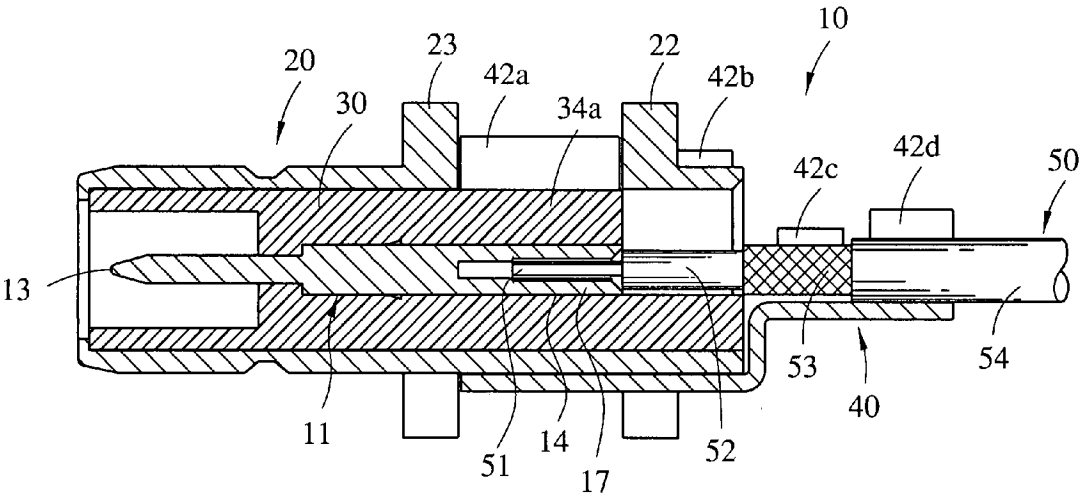
FIGS. 4A and 4B are sectioned side views showing the steps of connecting a coaxial cable to the connector of the present invention.
Figure 4B:
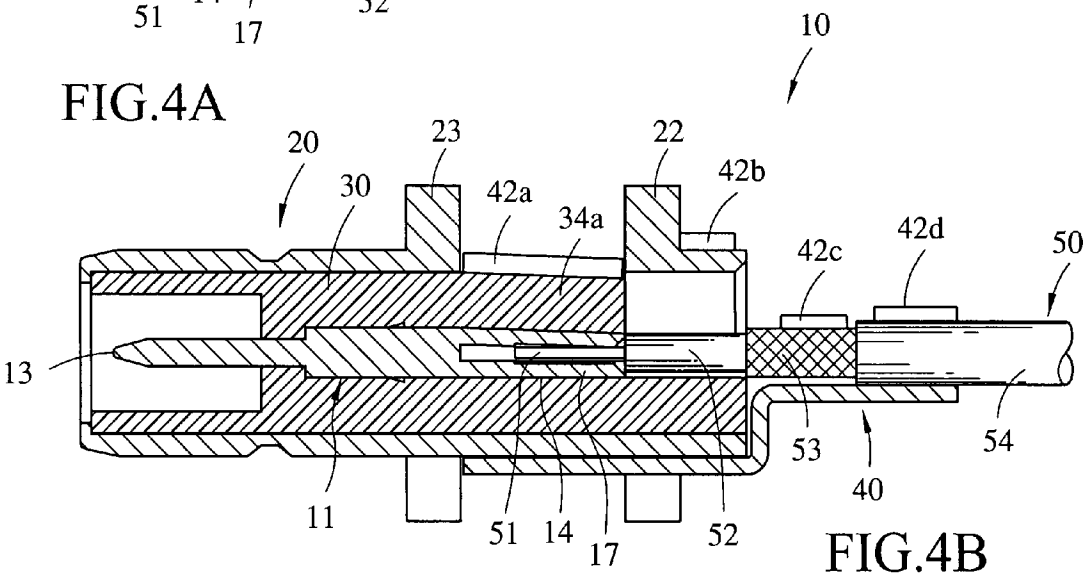

When the center conductor 51 of the coaxial cable 50 has been fully inserted into the elongate hole 15 of the connecting terminal 11 in the connector 10, as shown in FIG. 4A, the first, the third, and the fourth pair of wings 42*a*, 42*c*, and 42*d* of the fixing element 40 are sequentially bent inward using a tool, as shown in FIG. 4B. The inward bent first pair of wings 42*a* radially compresses against an outer surface of the shorter half 34*a* of the split end portion 34 of the insulating element 30, causing the shorter half 34*a* to deform and apply a force to the split end portion 17 of the connecting terminal 11, so that the connecting terminal 11 is compressed to firmly clamp the center conductor 51 of the coaxial cable 50 in the split end portion 17, preventing the coaxial cable 50 from separating from the connector 10. The inward bent third pair of wings 42*c* is directly pressed against an outer surface of the cylindrical conducting screen 53 of the coaxial cable 50 to form a grounding contact. The inward bent fourth pair of wings 42*d* is directly pressed against the outer sheath 54 of the coaxial cable 50. In this manner, the coaxial cable 50 and the connector 10 are firmly connected to each other.

Figure 5:
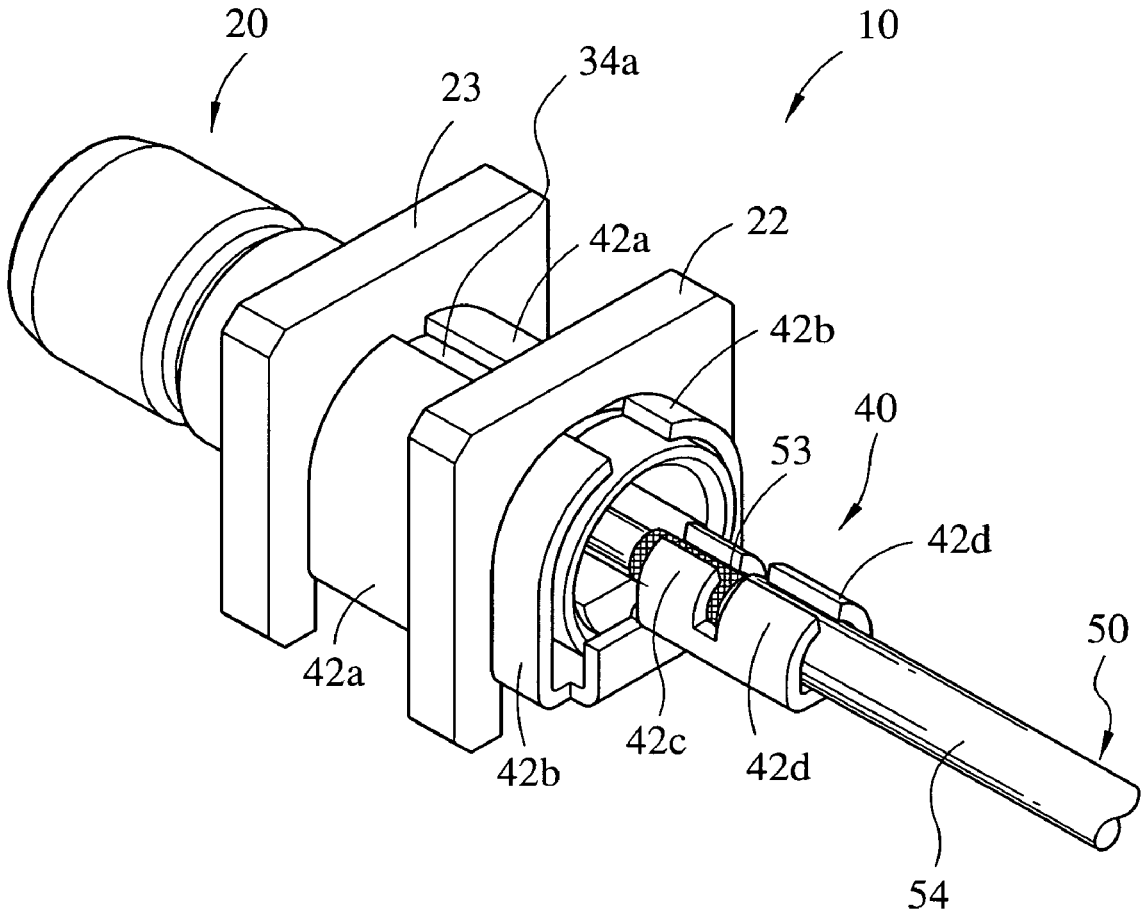
FIG. 5 is an assembled perspective view showing the connector of the present invention with a coaxial cable connected thereto.

FIGS. 4A and 4B show the steps of connecting the coaxial cable 50 to the connector 10 of the present invention. First, get a free end of the coaxial cable 50 ready for use, and insert the center conductor 51 into the connecting terminal 11 until the front end of the insulating spacer 52 is abutted on the rear end 14 of the connecting terminal 11. At this point, the center conductor 51 of the coaxial cable 50 has been fully received in the connecting terminal 11, as shown in FIG. 4A. Second, use a clamping tool to apply force on outer surfaces of the first, the third, and the fourth pair of wings 42*a*, 42*c*, and 42*d*, forcing them to deform and bent inward. Please refer to FIGS. 4B and 5 at the same time. The inward bent first pair of wings 42*a* radially compresses against the outer surface of the shorter half 34*a* exposed from the curved connecting plate 24 located between the front and the rear stop plate 22, 23 of the metal housing 20, causing the shorter half 34*a* to apply a force on the split end portion 17 of the connecting terminal 11 until the split end portion 17 and the center conductor 51 of the coaxial cable 50 are mechanically firmly connected to each other to ensure good electrical connection of the coaxial cable 50 to the connector 10. The inward bent third pair of wings 42*c* is tightly associated with the cylindrical conducting screen 53 of the coaxial cable 50 for the connector 10 to provide good grounding effect. The inward bent fourth pair of wings 42*d* is tightly associated with the outer sheath 54 of the coaxial cable 50, so that the coaxial cable 50 has good pull-out resistance without the risk of loosening or separating from the connector 10.

In brief, the connector 10 for coaxial cable according to the present invention includes a first pair of wings 42*a* that generates sufficient compression force to clamp the center conductor 51 of the coaxial cable 50 to the connecting terminal 11 in the connector 10. More specifically, when the first pair of wings 42*a* is deformed and bent inward, it radially compresses the outer surface of the insulating element 30 in the metal housing 20 of the connector 10, causing the insulating element 30 to apply a force on the split end portion 17 of the connecting terminal 11, so that the split end portion 17 is inward compressed to firmly hold the center conductor 51 of the coaxial cable 50 therein, allowing the coaxial cable 50 to well mechanically and electrically connect to the connector 10.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A connector for coaxial cable, the coaxial cable including a center conductor, an insulating spacer surrounding the center conductor, at least one cylindrical conducting screen surrounding the insulating spacer, and an outer sheath surrounding the cylindrical conducting screen; the connector being configured to ensure good mechanical and electrical connection to the coaxial cable, and comprising:

a metal housing internally defining an axial guide way, and having a predetermined portion in the form of a curved connecting plate;

an insulating element mounted in the axial guide way of the metal housing and having a first and a second end, the second end having an axially extended slit to thereby form a split end portion;

a connecting terminal inserted in the split end portion of the insulating element to associate with the insulating element; the connecting terminal having a rear end with an axially extended slit to thereby form a split end portion, into which the center conductor of the coaxial cable is inserted to electrically connect to the connecting terminal; and a fixing element attached to an outside of the metal housing, and including a main body with at least a first pair of wings formed thereon to locate at an outer side of the curved connecting plate of the metal housing;

whereby when the first pair of wings is inward bent to compress against a portion of the insulating element exposed from the curved connecting plate of the metal housing, the compressed portion of the insulating element applies a force to press against the split end portion of the connecting terminal, so that the center conductor of the coaxial cable is firmly clamped and held in the split end portion of the connecting terminal without the risk of loosening or separating from the connector.

2. The connector for coaxial cable as claimed in claim 1, wherein the main body of the fixing element is further provided at predetermined positions with a second, a third, and a fourth pair of wings.

3. The connector for coaxial cable as claimed in claim 2, wherein the metal housing includes a front and a rear stop plate, and the curved connecting plate being located between the front and the rear stop plate.

4. The connector for coaxial cable as claimed in claim 3, wherein the front stop plate of the metal housing has a circular flange forward extended therefrom; and the second pair of wings being bent inward to directly press against an outer surface of the circular flange, so that the fixing element is associated with the metal housing.

5. The connector for coaxial cable as claimed in claim 2, wherein the third pair of wings is bent inward to directly press against an outer surface of the cylindrical conducting screen of the coaxial cable to thereby form a grounding contact.

6. The connector for coaxial cable as claimed in claim 2, wherein the fourth pair of wings is bent inward to directly press against the outer sheath of the coaxial cable to thereby provide the coaxial cable with an increased pull-out resistance.

7. The connector for coaxial cable as claimed in claim 1, wherein the split end portion of the insulating element includes a shorter half and a longer half, and the first pair of wings of the fixing element is inward bent to compress an other surface of the shorter half, causing the shorter half to apply a force against the connecting terminal.

* * * * *